US009174767B2

(12) United States Patent
Cance et al.

(10) Patent No.: US 9,174,767 B2
(45) Date of Patent: Nov. 3, 2015

(54) SHIPPING PALLET WITH FORK PASS-THROUGH PROTECTION

(71) Applicant: International Business Machines Corporation, Armonk, NY (US)

(72) Inventors: Paul J. Cance, Durham, NC (US); William J. Green, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/221,757

(22) Filed: Mar. 21, 2014

(65) Prior Publication Data

US 2015/0266613 A1 Sep. 24, 2015

(51) Int. Cl.
*B65D 19/00* (2006.01)
*B65D 19/38* (2006.01)

(52) U.S. Cl.
CPC ..... *B65D 19/38* (2013.01); *B65D 19/0004* (2013.01)

(58) Field of Classification Search
CPC ..... B65D 19/385; B65D 19/0038; B65D 19/0024; B65D 2519/00323; B65D 2519/00293; B65D 2519/00298; B65D 2519/00333; B65D 19/0095; B65D 2519/00273
USPC ..... 108/51.11, 57.17, 57.25, 57.31, 57.33, 108/901; 206/386, 596, 598, 599, 600
See application file for complete search history.

(56) References Cited

U.S. PATENT DOCUMENTS

| | | | | | |
|---|---|---|---|---|---|
| 2,536,883 | A | * | 1/1951 | McDonald et al. | 414/373 |
| 2,670,865 | A | * | 3/1954 | Merrick | 414/437 |
| 2,873,935 | A | * | 2/1959 | De Pew et al. | 108/57.17 |
| 4,173,099 | A | * | 11/1979 | Robb | 49/168 |
| 5,060,344 | A | * | 10/1991 | Cress | 16/332 |
| 5,221,176 | A | | 6/1993 | Allen et al. | |
| 5,826,957 | A | * | 10/1998 | DeBartolo et al. | 312/326 |
| 5,870,958 | A | * | 2/1999 | Suzuki | 108/54.1 |
| 5,897,286 | A | | 4/1999 | Whittaker | |
| 6,216,608 | B1 | * | 4/2001 | Woods et al. | 108/57.25 |
| 6,234,086 | B1 | * | 5/2001 | Mason | 108/51.11 |
| 2005/0196265 | A1 | | 9/2005 | Moore et al. | |
| 2005/0252622 | A1 | * | 11/2005 | Reid | 160/180 |
| 2009/0178595 | A1 | * | 7/2009 | Chen | 108/57.25 |
| 2013/0032064 | A1 | | 2/2013 | Randall et al. | |

* cited by examiner

*Primary Examiner* — Janet M Wilkens
(74) *Attorney, Agent, or Firm* — Scott S. Dobson; Damion Josephs

(57) ABSTRACT

A pallet includes a support structure configured to accept fork tines, a deck secured to the support structure, and a plate secured to at least one of the deck and the support structure by a securing device. The securing device is configured to allow movement of the plate between a first position obstructing entry of a fork tine through the support structure and a second position allowing entry of a fork tine through the support structure. The securing device is configured to allow movement of the plate from the first position to the second position when a fork tine impacts the plate from a first direction. The plate is blocked from moving from the first position when a fork tine impacts the plate from a second direction opposing the first direction.

10 Claims, 5 Drawing Sheets

SHIPPING PALLET WITH FORK PASS-THROUGH PROTECTION

BACKGROUND

The present disclosure relates to the field of pallets, and more specifically, to pallets with fork tine pass-through protection.

Pallets are commonly used for supporting loads such that they can be moved with forklift, pallet jack, or any other device with fork tines. Pallets come in several different styles, but generally contain a deck, which the load rests on, and a support structure which supports the deck and provides for entry of fork tines. Some pallets are 2-way pallets which accept fork tines from two opposing directions. Some pallets are 4-way pallets which accept fork tines from four directions.

SUMMARY

According to embodiments of the present disclosure, a pallet with fork pass-through protection is disclosed. The pallet includes a support structure configured to accept fork tines, a deck secured to the support structure, and a plate secured to at least one of the deck and the support structure by a securing device. The securing device is configured to allow movement of the plate between a first position obstructing entry of a fork tine through the support structure and a second position allowing entry of a fork tine through the support structure. The securing device is configured to allow movement of the plate from the first position to the second position when a fork tine impacts the plate from a first direction. The securing device configured to prevent the plate from moving from the first position when a fork tine impacts the plate from a second direction opposing the first direction.

Also disclosed herein are embodiments of another pallet with fork pass-through protection. The pallet includes a support structure configured to accept fork tines, a deck secured to the support structure, and a plate secured to at least one of the deck and the support structure by a securing device. The securing device is configured to allow movement of the plate between a first position obstructing entry of a fork tine through the support structure and a second position allowing entry of a fork tine through the support structure. The securing device is configured to allow movement of the plate between the first position and the second position when a fork tine impacts the first plate from a first direction. The pallet also includes a stop secured to at least one of the deck and the support structure. The stop is configured to prevent the plate from moving from the first position when a fork tine impacts the first plate from a second direction opposing the first direction.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1C:
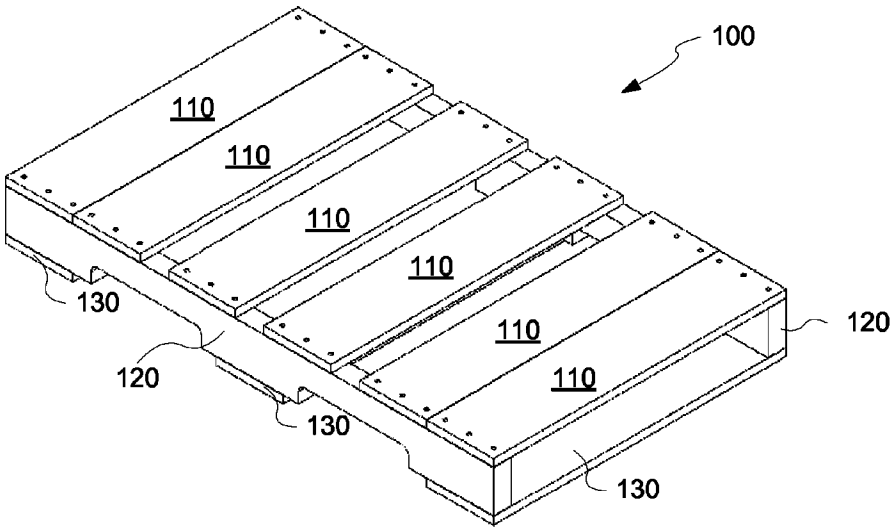
FIG. 1C depicts an angled view of a common stringer-style pallet.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to pallets, more particular aspects relate to pallets with fork tine pass-through protection. While the present disclosure is not necessarily limited to such applications, various aspects of the disclosure may be appreciated through a discussion of various examples using this context.

A common problem in shipping products is punctures caused by the tines of a forklift. This can happen when fork tines are longer than the pallet. A driver may make a load secure by driving the forks through the pallet. The fork tines may protrude out past the load the driver is carrying. The protrusion, in addition to the lack of visibility due to the load, may cause the driver to puncture other objects.

Embodiments of the present invention may include one or more plates secured to the pallet by securing devices such that they obstruct fork tine entry through the pallet. As used here, the term "obstruct" means "be in the way of" The plates may or may not block entry of the fork tine depending on the direction from which it impacts the plate as described below.

In some embodiments, the securing devices may allow movement of the plates when the plates are pushed from one direction and may block the plates from moving when the plates are pushed from an opposing direction. In some embodiments, the securing devices may allow the plates to swing about 90 degrees between a position essentially perpendicular to the deck to a position essentially parallel to the deck. This may allow a fork tine to push past the plate if the fork tine impacts the plate from one direction, while the fork tine is blocked from passing the plate if the fork tine impacts the plate from the opposing direction. In other embodiments, the securing devices may allow the plates to move between positions which are at a different angle than 90 degrees, such as an angle less than 90 degrees, while still having a position which obstructs fork tine entry and a position which allows for fork tine entry. The securing device may be any device which allows this movement such as a hinge.

In some embodiments, the securing device may be a living hinge. A living hinge is a flexible material connecting two rigid pieces. For example, a plastic plate may be connected by a thin, flexible piece of plastic to either the deck or the support structure of a pallet which is made of plastic or some other material.

In some embodiments, the securing device may allow movement of the plate, but a stop, separate from the securing device, may prevent the plate from moving past a certain point in a certain direction. The stop may be a typical part of the support structure which restricts movement of the plate, or the stop may be an additional part which is secured to the support structure, deck, or plate.

Some embodiments may contain two plates that are each secured to the pallet by a securing device. The plates may be secured at opposing ends of the pallet. The plates may be arranged such that a fork tine may enter the pallet from either a first direction or the opposing direction, but the fork tine may be blocked from exiting out the other end and protruding out of the pallet. The first plate impacted may move to allow entry of a fork tine and the second plate may block the fork tine and keep the fork tine from protruding out of the pallet. Similarly, some embodiments may include four plates for pallets which allow four-way entry of fork tines such that the a fork tine may enter the pallet from four directions and may be prevented from protruding out through the pallet. Additionally, multiple plates may be placed on one or more sides of a pallet instead of one. This may be used, for example, when there is more than one entry channel for fork tines on a side. A separate plate may be used for each channel.

FIGS. 1-3 depict stringer-style pallets with notches in the stringers to allow four-way entry of fork tines. However, embodiments of the present invention apply to any type of pallet such as 2-way stringer-style pallets and 4-way block style pallets. Additionally, embodiments of the present invention may apply to pallets made of any material such as wood, paper, plastic or metal. Further, different parts of the pallet may be made of different materials. For example, the deck and support structure may be made of wood while the plate may be made of metal.

Figure 1B:
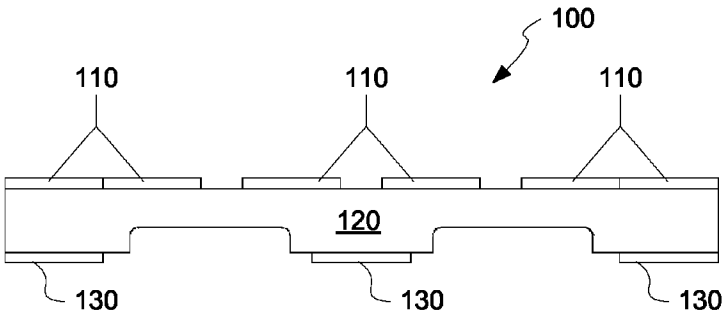
FIG. 1B depicts a side view of a common stringer-style pallet.
Figure 1A:
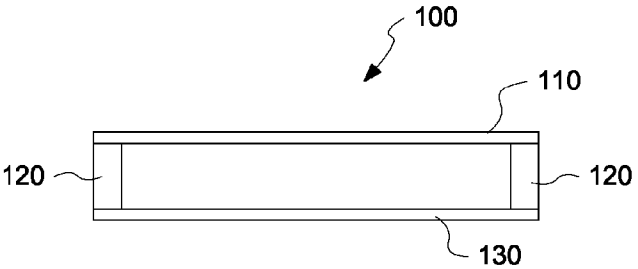
FIG. 1A depicts an end view of a common stringer-style pallet.

Referring now to FIGS. 1A-C, multiple views of a common stringer-style pallet 100 are depicted. FIG. 1A depicts an end view of pallet 100. FIG. 1B depicts a side view of pallet 100. FIG. 1C depicts an angled view of pallet 100. As shown, pallet 100 has six boards 110 which make up the deck. The deck is secured to a support structure comprising two stringers 120 and three base boards 130. Fork tines may be inserted into the ends of the pallet in the space between the two stringers 120. Additionally, stringers 120 each have notches for accepting fork tines through the sides of the pallet. Thus, pallet 100 may be capable of receiving fork tines from four directions.

Figure 2A:
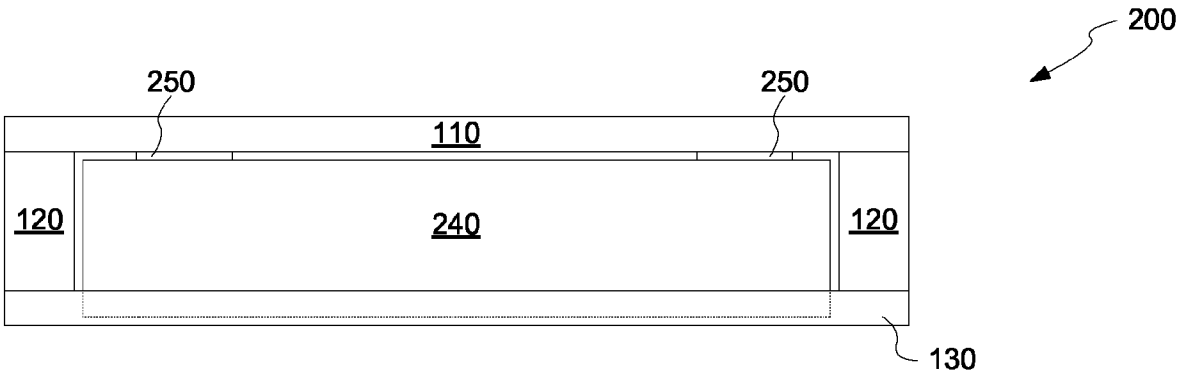
FIG. 2A depicts an end view of an example stringer-style pallet for preventing fork pass-through with two plates.
Figure 2B:
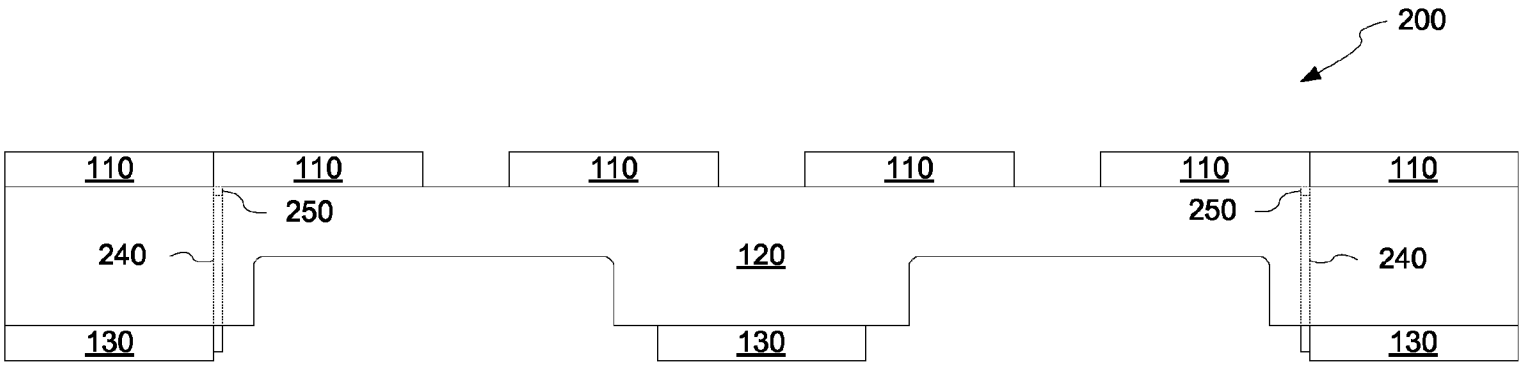
FIG. 2B depicts a side view of an example stringer-style pallet for preventing fork pass-through with two plates.

Referring to FIGS. 2A and 2B, an example pallet 200 with two plates is depicted. FIG. 2A depicts an end view of pallet 200. FIG. 2B depicts a side view of pallet 200. Similar to pallet 100 in FIGS. 1A, 1B, and 1C, pallet 200 has six boards 110 which make up the deck and a support structure comprising two stringers 120 and base boards 130. Additionally, pallet 200 has plates 240 which are each secured to a board 110 of the deck by hinges 250. Plates 240 obstruct passage of fork tines through the ends of pallet 200. In FIG. 2A, dotted lines are used to show plate 240 behind base board 130. In FIG. 2B, dotted lines are used to show plates 240 and hinges 250 behind stringer 120.

Hinges 250 may allow for plates 240 to rotate inward toward the deck from the position depicted. As depicted, base boards 130 are stops to plates 240 which prevent them from moving outward from the position depicted. This may allow for fork tines to impact the outside surface of plates 240 and cause the plate to rotate inward and up towards the deck to allow entry of the fork tines. However, this may also allow plates 240 to remain in place and block passage of fork tines when impacted by the fork tines on the inside surface of plates 240. Thus, a fork tine may enter either end of the pallet and pass by the first plate before being stopped by the second plate at the opposing end. This may help prevent fork tines from sticking out through the back end of the pallet.

In some embodiments, the stops may be an addition to the support structure. In some embodiments, hinges 250 may be configured to prevent plates 240 from moving outward from the position depicted.

Figure 3A:
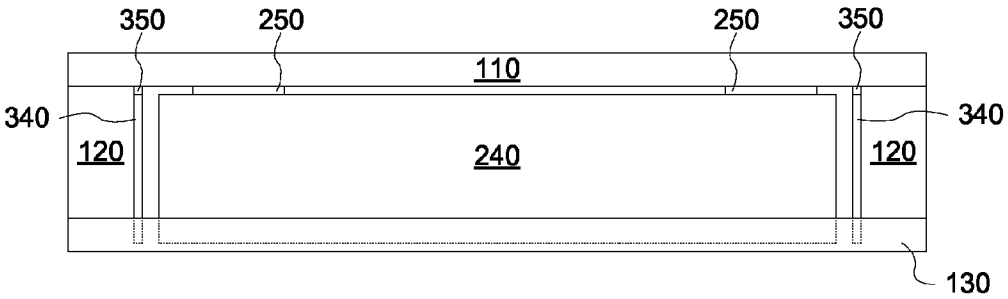
FIG. 3A depicts an end view of an example stringer-style pallet for preventing fork pass-through with six plates.
Figure 3B:
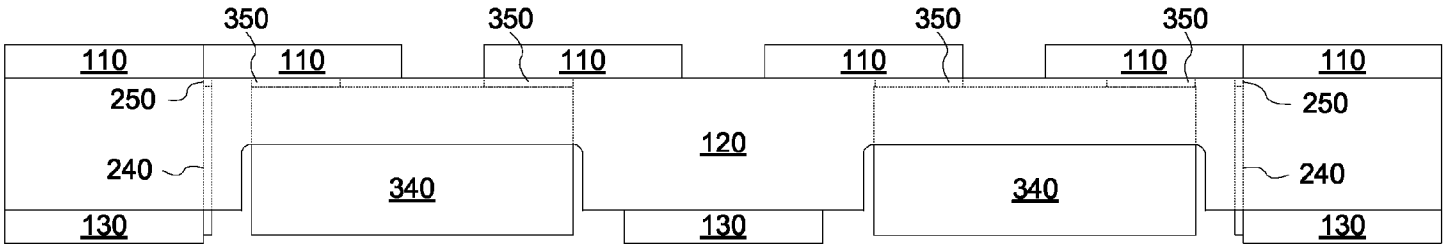
FIG. 3B depicts a side view of an example stringer-style pallet for preventing fork pass-through with six plates.

Referring to FIGS. 3A and 3B, another example pallet 300 with six plates is depicted. FIG. 3A depicts an end view of pallet 300. FIG. 3B depicts a side view of pallet 300. Similar to pallet 200 depicted in FIGS. 2A and 2B, pallet 300 has six boards 110 which make up the deck, a support structure comprising two stringers 120 and base boards 130, and plates 240 which are each secured to the deck by hinges 250. Additionally, pallet 300 has four plates 340 secured by hinges 350 to the boards 110 of the deck. Hinges 350 may allow the plates to rotate inward toward the deck from the position depicted. As depicted, plates 340 obstruct entry of fork tines through the notches in stringers 120 and a separate plate 340 is provided for each notch. In the depicted embodiment, stringers 120 are a stop which prevents plates 340 from moving outward from the position depicted.

Figure 4A:
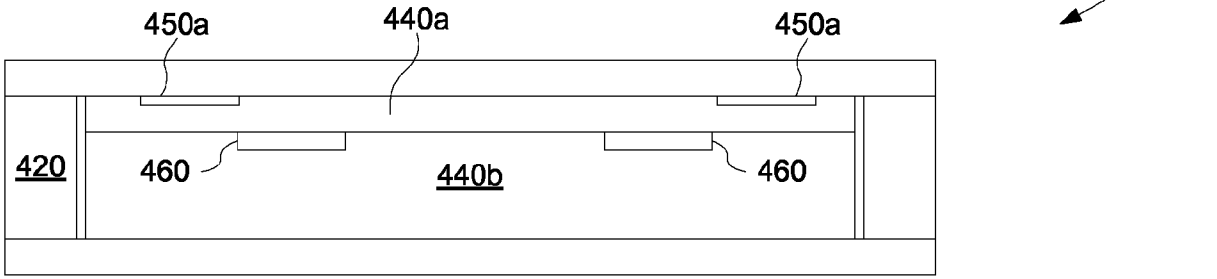
FIG. 4A depicts an end view of an example stringer-style pallet for preventing fork pass-through with fork tines inserted through one end.
Figure 4B:
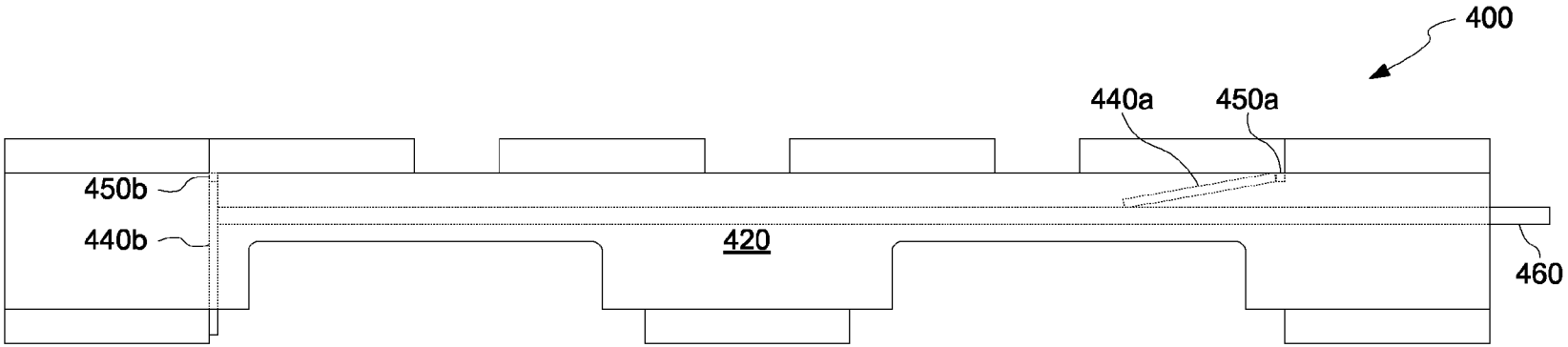
FIG. 4B depicts a side view of an example stringer-style pallet for preventing fork pass-through with fork tines inserted through one end.

Referring to FIGS. 4A and 4B, an example pallet 400 with a pair of fork tines 460 inserted through one end. FIG. 4A depicts an end view of pallet 400. FIG. 4B depicts a side view of pallet 400. Tines 460 may be part of a forklift or any other equipment. Dotted lines are used in FIG. 4B to show the position of plates 440*a* and 440*b*, hinges 450*a* and 450*b*, and tines 460 behind stringer 420.

As shown in FIG. 4B, tines 460 may have impacted plate 440*a* from the right end and hinge 450*a* may have allowed plate 440*a* to rotate inward to allow entry of tines 460. Plate 440*b* may have been impacted by tines 460 and blocked them from passing through the left end of pallet 400. If tines 460 had entered from the left end, hinge 450*b* may have allowed plate 440*b* to rotate inward and allow entry of tines 460 while plate 440*a* blocked tines 460 from passing through the right end of the pallet.

Figure 5:
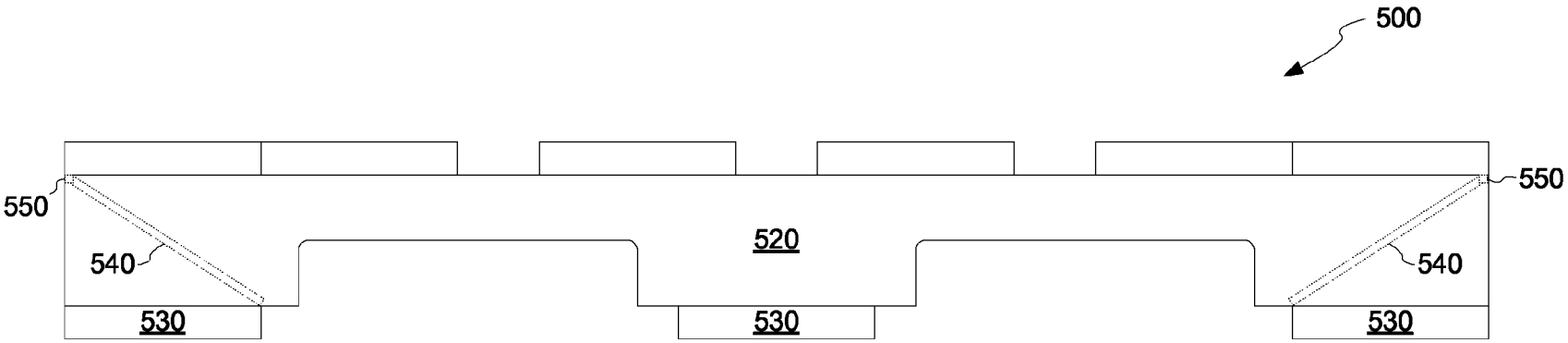
FIG. 5 depicts a side view of an example stringer-style pallet for preventing fork pass-through with two plates.

Referring to FIG. 5, a side view of an example pallet 500 with two plates 540 is depicted. As depicted, baseboards 530 are stops which block plates 540 at an angle less than 90 degrees to the deck. This may allow for a fork tine to slide further into pallet 500, which may provide better stability for lifting pallet 500. Hinges 550 may allow plates 540 to rotate inward towards the deck when impacted by a fork tine entering from outside the pallet. Baseboards 530 may prevent plates 540 from moving when impacted by a fork tine from the inside.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A pallet comprising:

a support structure, the support structure configured to accept fork tines, the support structure comprising one or more baseboards;

a deck secured to the support structure; and a first plate secured to at least one of the deck and the support structure by a first securing device, the first securing device configured to allow movement of the first plate between a first position obstructing entry of a fork tine through the support structure and a second position allowing entry of a fork tine through the support structure, the first securing device configured to allow movement of the first plate from the first position to the second position when a fork tine impacts the first plate from a first direction, wherein a first of the one or more baseboards prevents the first plate from moving from the first position when a fork tine impacts the first plate from a second direction, the second direction opposing the first direction.

2. The pallet of claim 1, further comprising:

a second plate secured to at least one of the deck and the support structure by a second securing device, the first plate secured toward a first side of the pallet and the second plate secured toward a second opposing side of the pallet, the second securing device configured to allow movement of the second plate from the first position to the second position when a fork tine impacts the first plate from the second direction, wherein a second of the one or more baseboards prevents the second plate from moving from the first position when a fork tine impacts the second plate from the first direction.

3. The pallet of claim 2, further comprising:

a third plate secured to at least one of the deck and the support structure by a third securing device, the third plate secured toward a third side of the pallet, the third securing device configured to allow movement of the third plate from the first position to the second position when a fork tine impacts the third plate from a third direction, wherein the support structure comprises a plurality of stringers, and wherein a first stringer of the plurality of stringers prevents the third plate from moving from the first position when a fork tine impacts the third plate from a fourth direction, the fourth direction opposing the third direction; and a fourth plate secured to at least one of the deck and the support structure by a fourth securing device, the fourth plate secured toward a fourth side of the pallet, the fourth side of the pallet opposing the third side, the fourth securing device configured to allow movement of the fourth plate from the first position to the second position when a fork tine impacts the fourth plate from the fourth direction, wherein a second stringer of the plurality of stringers prevents the fourth plate from moving from the first position when a fork tine impacts the fourth plate from the third direction.

4. The pallet of claim 3, wherein the securing devices are hinges.

5. The pallet of claim 2, wherein the securing devices are hinges.

6. The pallet of claim 1, wherein the first securing device is a hinge.

7. The pallet of claim 1, wherein the support structure comprises stringers.

8. The pallet of claim 1, wherein the support structure and the deck are made of wood.

9. The pallet of claim 1, wherein the plate is made of metal.

10. The pallet of claim 1, wherein the deck, the support structure, the plate and the securing device are made of plastic, and wherein the securing device is a living hinge.

* * * * *